US006726525B1

(12) United States Patent
Kato et al.

(10) Patent No.: US 6,726,525 B1
(45) Date of Patent: Apr. 27, 2004

(54) METHOD AND DEVICE FOR GRINDING DOUBLE SIDES OF THIN DISK WORK

(75) Inventors: Tadahiro Kato, Nishishirakawa-gun (JP); Shunichi Ikeda, Nishishiraka-gun (JP); Kenji Ohkura, Yao (JP)

(73) Assignees: Shin-Estu Handotai Co., Ltd., Tokyo (JP); Koy Machine Industries Co., Ltd., Yao (JP)

( * ) Notice: Subject to any disclaimer, the term of this patent is extended or adjusted under 35 U.S.C. 154(b) by 14 days.

(21) Appl. No.: 09/831,893

(22) PCT Filed: Sep. 13, 2000

(86) PCT No.: PCT/JP00/06250

§ 371 (c)(1),
(2), (4) Date: Aug. 28, 2001

(87) PCT Pub. No.: WO01/21356

PCT Pub. Date: Mar. 29, 2001

(30) Foreign Application Priority Data

Sep. 24, 1999 (JP) ..... 11-269979

(51) Int. Cl.[7] ..... B24B 49/00

(52) U.S. Cl. ..... 451/5; 451/41; 451/63; 451/261; 451/262; 451/268; 451/269

(58) Field of Search ..... 451/262, 264, 451/265, 268, 269, 274, 285, 290, 394, 402, 41, 63, 5

(56) References Cited

U.S. PATENT DOCUMENTS 3,774,348 A * 11/1973 Dunn ..... 451/262
3,846,940 A * 11/1974 Dunn ..... 451/269
5,121,572 A * 6/1992 Hilscher ..... 451/269
5,690,542 A * 11/1997 Ikemoto ..... 451/63
5,720,652 A * 2/1998 Steinwender et al. ..... 451/254
5,755,613 A * 5/1998 Uchida et al. ..... 451/41
5,791,976 A 8/1998 Honda
5,934,983 A * 8/1999 Wada et al. ..... 451/63
5,975,997 A * 11/1999 Minami ..... 451/287
5,989,108 A * 11/1999 Ikeda et al. ..... 451/268
6,165,054 A * 12/2000 Abe et al. ..... 451/262

FOREIGN PATENT DOCUMENTS

| | | |
|---|---|---|
| JP | 61-146460 | 7/1986 |
| JP | 10-128646 | 5/1998 |
| JP | 10-217079 | 8/1998 |
| JP | 10-277894 | 10/1998 |
| JP | 11-207577 | 8/1999 |

* cited by examiner

*Primary Examiner*—M. Rachuba
(74) *Attorney, Agent, or Firm*—Jacobson Holman PLLC

(57) ABSTRACT

A double side grinding apparatus comprises a pair of grinding wheels (4), work rotating device (1) and moving device (2). The apparatus operates to bring the grinding faces (4*a*) into contact with the respective work surfaces (a) to advance each grinding face to the position of a predetermined depth of cut by moving at least one of the grinding wheels (4) while rotating the grinding wheels (4) and rotating the work (W) by the device (1) about an axis thereof as supported in a predetermined grinding position so that an outer periphery of the work (W) intersects outer peripheries of the grinding wheels (4) with a center (c) of the work (W) positioned inwardly of the grinding faces (4*a*), stop each of the grinding wheels (4) from advancing in the direction of depth of cut, move each of the grinding wheels (4) and the work (W) by the moving device (2) relative to each other in a direction parallel to the work surface (a) until the center (c) of the work (W) is positioned externally of the grinding faces (4*a*), and separate the grinding faces (4*a*) from the work surfaces (a). The surfaces of the work can be ground at the same time easily with diminished variations in the thickness of the work although the apparatus is small-sized.

5 Claims, 6 Drawing Sheets

9
2
7
12
6
10
4a
11
3a
5
4
3
10
11
12
W
11
1
10
12
8

METHOD AND DEVICE FOR GRINDING DOUBLE SIDES OF THIN DISK WORK

TECHNICAL FIELD

The present invention relates to double side grinding process and apparatus for thin disklike work, and more particularly to a process and an apparatus for simultaneously grinding opposite surfaces of thin disklike work such as semiconductor wafers.

BACKGROUND ART

Apparatus for grinding opposite surfaces of work at the same time are already known wherein the work as placed in a pocket (hole) of a rotating disklike carrier is passed between a pair of grinding wheels having grinding faces provided by their end faces and opposed to each other. In this case, the grinding faces of the wheels must be greater than the work in outside diameter. The carrier is usually provided with a plurality of pockets formed on a circumference close to its outer periphery and equidistantly spaced apart. A portion of the carrier is also positioned between the pair of grinding wheels along with the wafer. The thickness of this portion of the carrier of course needs to be smaller than the clearance between the pair of grinding wheels during grinding, namely, the thickness of the work as finished.

The semiconductor wafers presently available include those having an outside diameter of about 200 mm (8 inches) and those with an outside diameter of about 300 mm (12 inches), and are all about 0.8 mm in thickness (as finished by grinding). Thus, the thickness is very small as compared with the outside diameter. In the case where such wafers are to be ground by the apparatus described above, the grinding wheels have a large outside diameter, and the carrier which rotates with the wafer held thereon also has a large size since the wafer is relatively large in outside diameter, consequently making the apparatus large-sized. Further because the wafer has a small thickness, the portion of the carrier to be positioned between the grinding wheels along with the wafer needs to have a greatly reduced thickness. Although a grinding force acts on the carrier positioned between the grinding wheels, especially on the pocket portion thereof, through the work accommodated in the pocket, this portion will have a lower strength if reduced in thickness, presenting difficulty in moving the work smoothly. For this reason, it has heretofore been difficult to grind opposite surfaces of wafers.

The same problem is encountered also with thin disklike work other than wafers.

To overcome the above problem, the present applicant has proposed a double side grinding apparatus for thin disklike work which apparatus comprises a pair of rotatable annular grinding wheels having opposed annular grinding faces provided by respective end faces thereof and so arranged as to be movable relative to each other axially thereof, and work rotating means for rotating the thin disklike work about its own axis while supporting the work in a grinding position between the grinding faces so that opposite surfaces of the work to be worked on face the respective grinding faces of the pair of wheels, with the outer periphery of the work intersecting the outer periphery of each grinding face and with the center of the work positioned inwardly of the grinding faces [see JP-A No. 10-128646 (1998)].

With this apparatus, the pair of grinding wheels are usually so arranged that the opposed grinding faces are positioned in parallel to each other. Thin disklike work is ground over opposite surfaces thereof in the following manner. With the work rotated about its own axis in the grinding position, the pair of grinding wheels are rotated and moved toward each other, whereby the grinding faces are brought into contact with the respective corresponding work surfaces to advance each grinding face to the position of a predetermined depth of cut. The grinding wheels are stopped from advancing in the directions of depth of cut for spark-out grinding and thereafter moved away from each other to separate the grinding faces from the work surfaces.

With this apparatus, the entire surfaces of the work pass between the grinding faces in contact therewith while the work makes one turn of rotation about its center, with the outer periphery of the work intersecting the outer peripheries of the grinding faces and with the center of the work positioned inwardly of the grinding faces, whereby both work surfaces can be entirely ground at the same time.

However, the portion of the work other than the portion thereof in the vicinity of its center comes into contact with the grinding faces only during a portion of the time taken for each turn of rotation of the work, whereas the central portion in the vicinity of the center is in contact with the grinding faces at all times. Accordingly, the central portion is greater than the other portion in the amount of grinding. This results in the problem that the work as ground has an increased thickness toward its outer periphery and a reduced thickness in the vicinity of its center, hence great variations in the thickness of the work.

An object of the present invention is to overcome the foregoing problems and to provide double side grinding process and apparatus for thin disklike work which ensure diminished variations in the thickness of work as ground.

DISCLOSURE OF THE INVENTION

The present invention provides a process for grinding opposite surfaces of thin disklike work simultaneously with annular grinding faces of ends of a pair of grinding wheels arranged as opposed to each other, the process being characterized by bringing the grinding faces into contact with the respective work surfaces to advance each grinding face to the position of a predetermined depth of cut by moving at least one of the grinding wheels while rotating the grinding wheels and rotating the work about an axis thereof as supported in a predetermined grinding position between the grinding wheels so that an outer periphery of the work intersects outer peripheries of the grinding wheels with a center of the work positioned inwardly of the grinding faces, stopping each of the grinding wheels from advancing in the direction of depth of cut, moving each of the grinding wheels and the work relative to each other in a direction parallel to the work surface until the center of the work is positioned externally of the grinding faces and separating the grinding faces from the work surfaces.

The grinding wheels are rotated at a higher speed than the work. Preferably, each of the grinding wheels is stopped from advancing in the direction of depth of cut after advancing to the position of a predetermined depth of cut to start spark-out grinding, and each grinding wheel and the work are moved relative to each other in a direction parallel to the work surface before the spark-out grinding operation is completed. However, simultaneously when the grinding wheels are stopped from advancing in the directions of depth of cut after advancing into the work depthwise at a very low speed, each grinding wheel and the work can be moved relative to each other in a direction parallel to the work surface to be worked on. Further alternatively, the spark-out grinding operation is continued after each grinding wheel and the work are stopped from moving relative to each other, and each grinding face is moved away from the work surface after the spark-out grinding operation is completed, or simultaneously when each grinding wheel and the work are stopped from moving relative to each other, the spark-out grinding operation is terminated, and each grinding face is moved away from the work surface. Each grinding face may be moved away from the corresponding work surface by moving each grinding wheel and the work relative to each other until the work is brought out from between the pair of grinding wheels.

The work surfaces to be worked on are ground by advancing the grinding wheels in rotation toward the directions of depth of cut, with the grinding faces thereof in contact with the respective work surfaces. The entire surfaces of the work pass between the grinding faces in contact therewith while the work makes one turn of rotation about its center, with the outer periphery of the work intersecting the outer peripheries of the grinding faces and with the center of the work positioned inwardly of the grinding faces. Accordingly, both work surfaces can be entirely ground at the same time by merely rotating the work about its center in this arrangement when the grinding faces of the wheels have an outside diameter which is slightly greater than the radius of the work. The work needs only to be rotated about its center in this arrangement although it is conventionally necessary to move the work with use of a carrier or the like. Even when in the form of a thin disk, the work can therefore be ground with ease reliably using a compacted apparatus. The work surfaces can be entirely ground by using grinding wheels having grinding faces with an outside diameter slightly greater than the radius of the work, and there is no need to use great grinding wheels whose grinding faces are greater than the work in outside diameter. This also serves to make the apparatus compact.

If the center of the work is positioned externally of the grinding faces, the portion of the work in the vicinity of its center is held totally out of contact with the grinding faces. Accordingly when each grinding wheel is advanced to the position of a predetermined depth of cut and thereafter stopped from advancing in the direction of depth of cut, and if each grinding wheel and the work are then moved relative to each other in a direction parallel to the work surface to be worked on until the center of the work is positioned externally of each grinding face, only the portion of the work other than the vicinity of the center of the work is ground, with the work portion in the vicinity of the center held out of contact with the grinding faces. The work ground is therefore diminished in the difference between the thickness of the portion of the work in the vicinity of its center and the thickness of the other portion of the work, hence diminished variations in the overall thickness of the work.

Thus, the process of the present invention makes it possible to simultaneously grind both surfaces of thin disklike work easily by a compact apparatus, with diminished variations in the thickness of the work ground.

Each of the grinding wheels and the work are moved relative to each other in a direction parallel to the work surface, preferably with the work rotated at a lower speed than in the preceding grinding operation.

Each of the grinding wheels and the work are moved relative to each other in a direction parallel to the work surface preferably by moving the work in a direction parallel to the work surface.

When to be moved, the pair of grinding wheels need to be moved while being held positioned relative to each other in a definite relationship with high accuracy, so that it is difficult to move each grinding wheel and the work relative to each other. However, if the work is made movable as described above, there is no need to move the grinding wheel, with the result that the wheel and work are easily movable relative to each other.

The present invention provides an apparatus comprising a pair of rotatable grinding wheels having opposed annular grinding faces at respective ends thereof and so arranged as to be movable relative to each other axially thereof, work rotating means for rotating thin disklike work about an axis thereof while supporting the work in a grinding position between the grinding faces so that opposite surfaces of the work to be worked on face the respective grinding faces of the wheels, and moving means for moving each of the grinding wheels and the work rotating means relative to each other in a direction parallel to the surfaces of the work supported by the rotating means, the apparatus being characterized by bringing the grinding faces into contact with the respective work surfaces to advance each grinding face to the position of a predetermined depth of cut by moving at least one of the grinding wheels while rotating the grinding wheels and rotating the work about an axis thereof as supported in a predetermined grinding position between the grinding wheels so that an outer periphery of the work intersects outer peripheries of the grinding wheels with a center of the work positioned inwardly of the grinding faces, stopping each of the grinding wheels from advancing in the direction of depth of cut, moving each of the grinding wheels and the work relative to each other in a direction parallel to the work surface until the center of the work is positioned externally of the grinding faces and separating the grinding faces from the work surfaces.

The work is rotated about its own axis by the work rotating means, as thereby supported in the grinding position, and the pair of grinding wheels are rotated at a higher speed than the work. At least one of the grinding wheels is moved in this state, whereby the grinding faces are brought into contact with the respective work surfaces and advanced each to the position of a predetermined depth of cut, with the outer periphery of the work intersecting the outer peripheries of the grinding faces and with the center of the work positioned inwardly of the grinding faces. With each of the grinding wheels stopped from advancing in the direction of depth of cut, each grinding wheel and the work are thereafter moved by the moving means in a direction parallel to the work surface until the center of the work is positioned externally of the grinding faces, and the grinding faces are separated from the work surfaces.

In this way, the foregoing process of the invention can be practiced by the apparatus of the invention, with the result that both surfaces of the thin disklike work can be ground easily at the same time as previously described, while it is possible to compact the apparatus and to diminish variations in the thickness of the work ground Preferably, the moving means moves the work in a direction parallel to the work surface to thereby move each of the grinding wheels and the work relative to each other in a direction parallel to the work surface.

The grinding wheel and the work can then be moved easily relative to each other as previously described.

BEST MODE OF CARRYING OUT THE INVENTION

With reference to the drawings, an embodiment of the present invention will be described below which is adapted for use in grinding opposite surfaces of semiconductor wafers.

Figure 1:
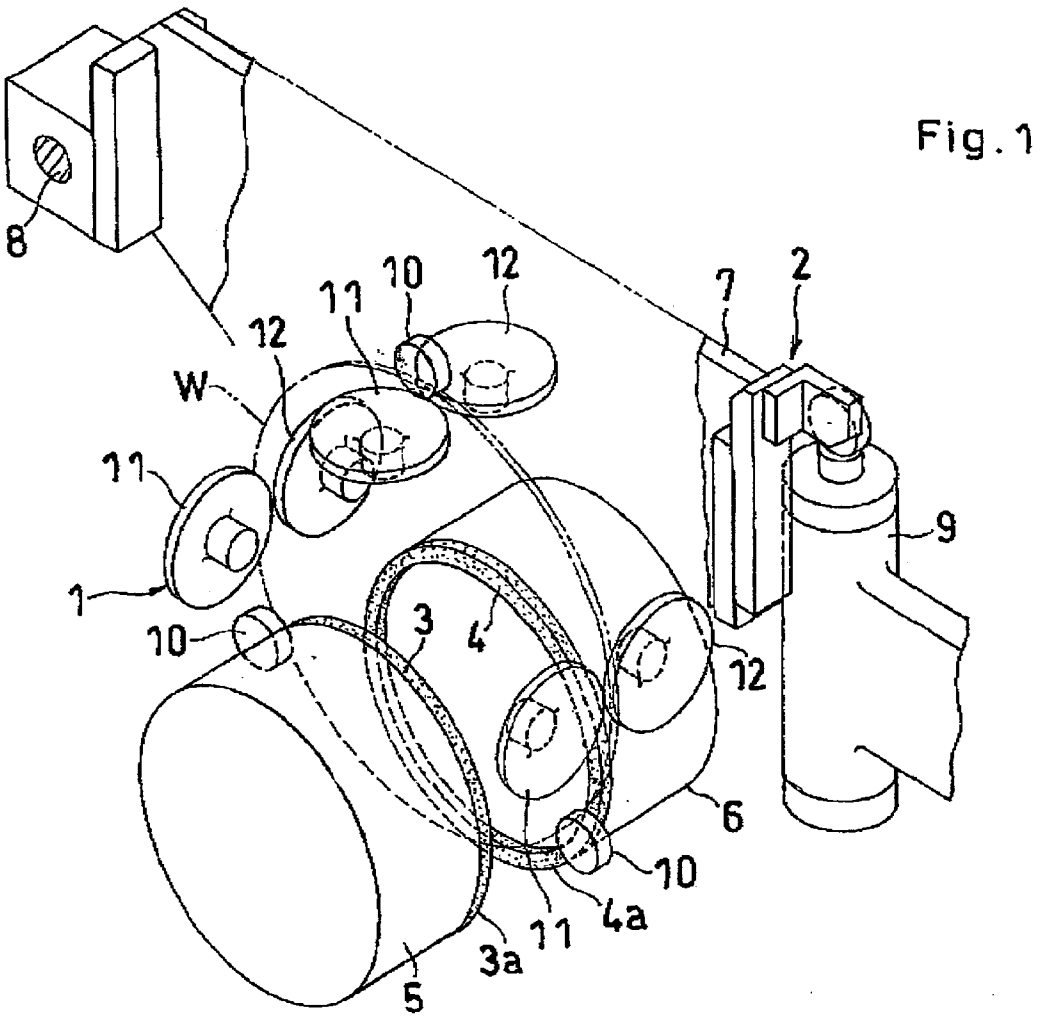
FIG. 1 is a perspective view of the main components of a double side grinding apparatus embodying the invention.
Figure 2:
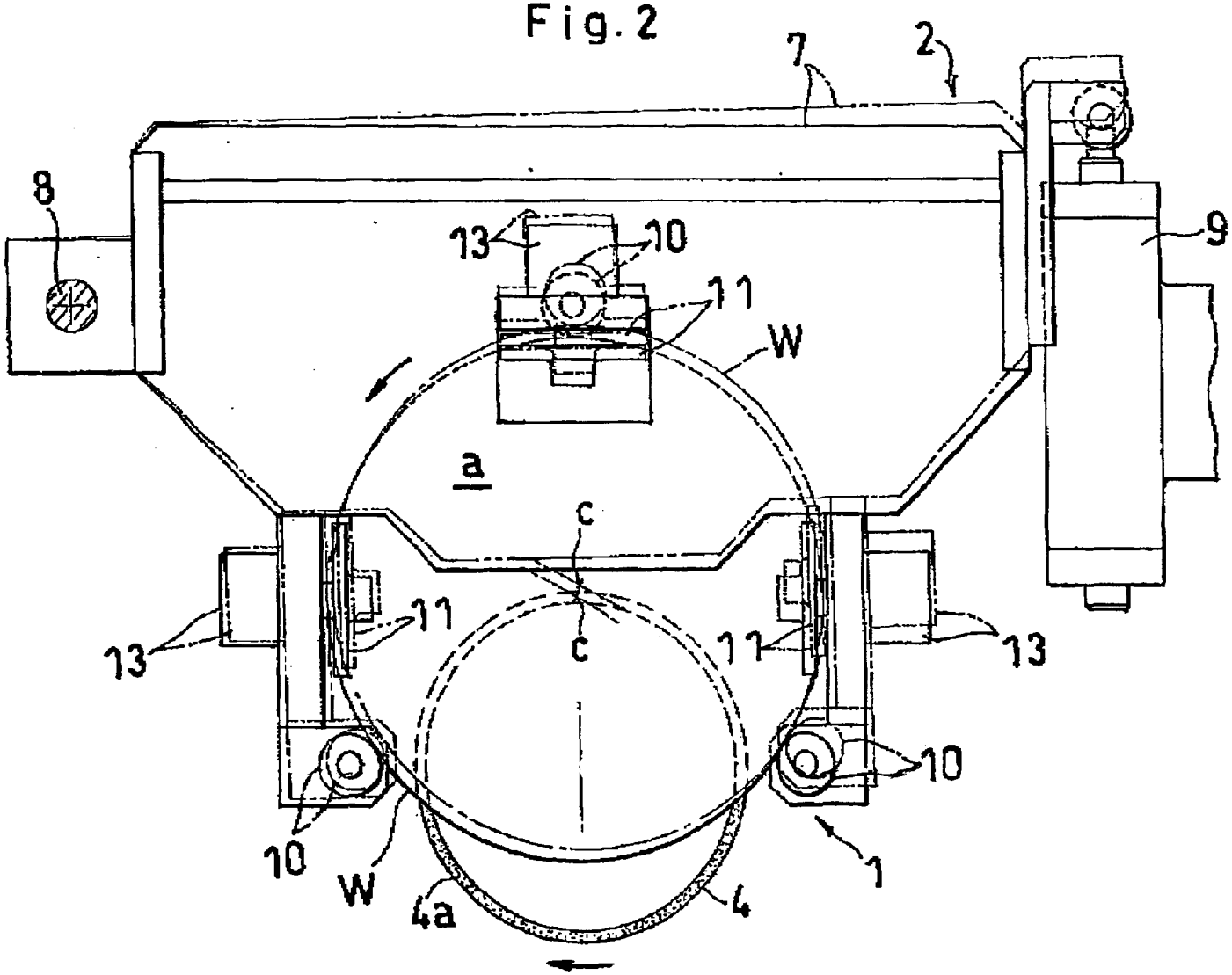
FIG. 2 is a left side elevation partly broken away of FIG. 1.
Figure 3:
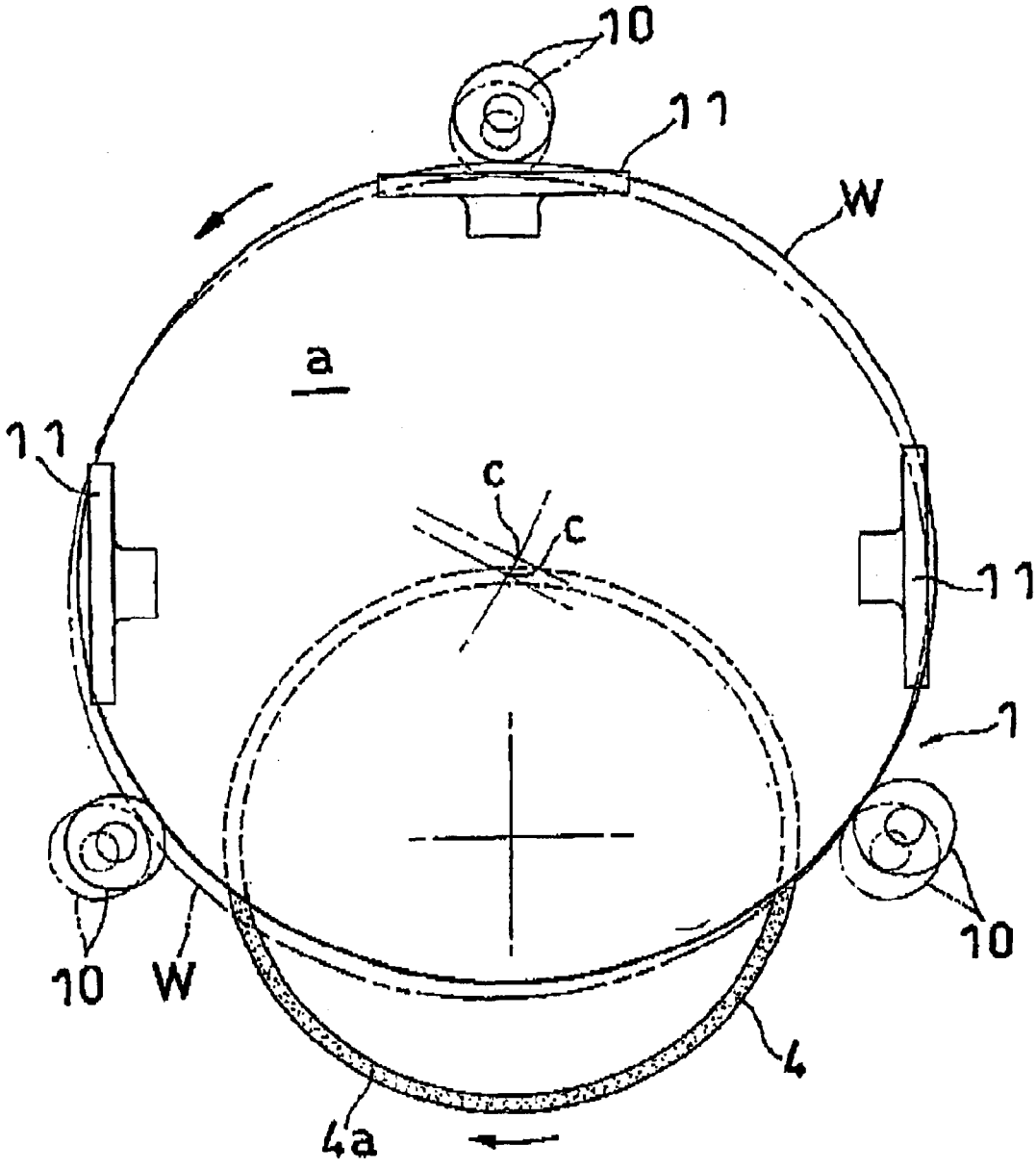
FIG. 3 is a left side elevation partly broken away and showing the main portion of FIG. 2 on an enlarged scale.
Figure 4:
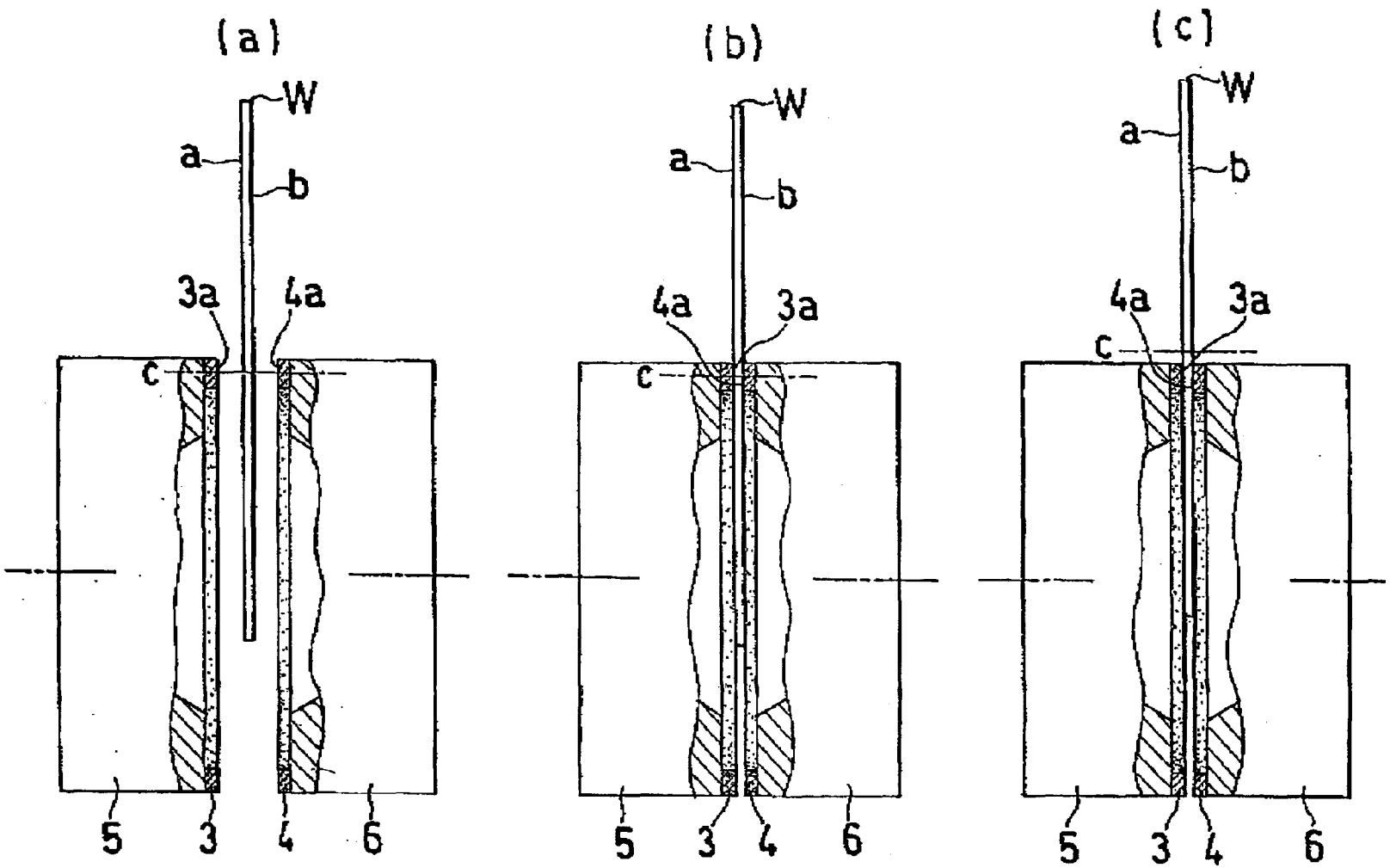
FIG. 4 includes front views showing the relationship between grinding wheels and work stepwise during grinding.

FIGS. 1 and 2 show the main components of a double side grinding apparatus. The apparatus comprises a horizontal double head surface grinding machine having added thereto a work rotating device 1 serving as means for rotating work about its own axis, and a moving device 2 serving as moving means. FIGS. 1 and 2 show a pair of grinding wheels 3, 4 only among the components of the grinding machine. In the following description, the front side of the plane of FIG. 2 will be referred to as "left," the rear side thereof as "right," the right-hand side the drawing as "front," and the left-hand side thereof as "rear." Further FIG. 3 shows the relationship between thin disklike work (wafer) W supported by the rotating device 1 and the grinding wheels 3, 4, and FIG. 4 shows the relationship between the work W and the grinding wheels 3, 4 during grinding.

The present embodiment is used for work W having no positioning flat portion. The outer periphery of the work W is perfectly circular. As will be described later, the work W is rotated about its center c by the rotating device 1 with opposite surfaces a, b thereof to be worked on facing leftward and rightward. The surface a facing to the left at this time will be referred to as the "left surface to be worked on," and the surface b facing to the right as the "right surface to be worked on."

Although not shown, the grinding machine has a bed, and left and right wheel heads fixed to the upper side of the bed. Horizontal spindles extending horizontally leftward or rearward are rotatably supported by the respective heads inside thereof. The left and right wheel heads have their posture so adjusted that the axes of the left and right spindles are in alignment with a common horizontal axis extending leftward or rightward, i.e., transversely of the apparatus. The spindles are movable relative to the respective wheel heads axially thereof (left-right direction). The left spindle projecting rightward from the left wheel head has an outer end fixedly provided with a left cuplike base 5 concentrically therewith. A left grinding wheel 3 in the form of a ring is fixed to a right open end face of the base 5 concentrically therewith. The grinding wheel 3 has a right end face serving as a left annular grinding face 3*a* orthogonal to the axis of the left spindle and centered about the axis. The right spindle projecting leftward from the right wheel head has an outer end fixedly concentrically provided with a right cuplike base 6 symmetric with the left base 5. A right grinding wheel 4 in the form of a ring and symmetric with the left grinding wheel 3 is fixed to a left open end face of the base 6 concentrically therewith. The grinding wheel 4 has a left end face serving as a right annular grinding face 4*a* orthogonal to the axis of the right spindle and centered about the axis. The left and right grinding faces 3*a*, 4*a* are parallel to each other. When axially moved, the left or right wheel spindle moves the left or right grinding wheel 3 or 4 axially relative to each other. The left and right wheel spindles are rotated at the same speed in the same direction by unillustrated drive means, with the result that the left and right grinding wheels 3, 4 are rotated at the same speed in the same direction. Incidentally, the grinding wheels 3, 4 may be different from each other in the direction and speed of rotation. The other part of the grinding machine can be of the same construction as known horizontal spindle double head surface grinding machines.

The work rotating device 1 is attached by the moving device 2 to the bed of the grinding machine.

The moving device 2 is adapted to move the rotating device 1 and the work W supported thereon generally upward or downward parallel to the surfaces a, b thereof to be worked on as will be described later, and has the following construction.

A support member 7 in the form of a vertical plate having a front-to-rear length larger than the vertical width thereof is mounted at its rear end on the bed so as to be movable upward or downward about a horizontal pivot 8 extending leftward or rightward, i.e., transversely of the apparatus, and has its front end attached to the bed by a suitable actuator 9. The support member 7 is moved upward or downward about the horizontal pivot 8 by the operation of the actuator 9. With reference to FIG. 2, the solid lines indicate the support member 7 as located in a lower limit position, while the chain lines indicate the support member 7 as located in an intermediate position slightly above the former position.

The rotating device 1 causes the work W to rotate about its own axis as supported vertically between the opposite grinding faces 3*a*, 4*a*, with the axis of the work in parallel to the axes of the grinding wheels 3, 4. The device 1 comprises outer periphery guide rollers 10, drive rollers 11 and holding rollers 12, the rollers of each kind being three in number. Although not shown in detail, the rollers 10, 11, 12 are all attached to the support member 7. Among the rollers 10, 11, 12, those required are located in an operative position where the rollers support and rotate the work W, or alternatively in a standby position where the work W is fed to or delivered from the rotating device 1. FIGS. 1 to 3 show the rollers 10, 11, 12 all as located in the operative position.

FIG. 3 shows the positions of the grinding wheels 3, 4, the rollers 10, 11, 12 of the rotating device 1 and the work W supported by the device 1, as seen from the left. The rotating device 1 and the work W thereby supported are moved upward or downward on a circular-arc path centered about the horizontal pivot 8 by the upward or downward pivotal movement of the support member 7. The solid lines in FIG. 2 and the chain lines in FIG. 3 indicate the work W as located in a lower limit grinding position, and the chain lines in FIG. 2 and the solid lines in FIG. 3 indicates the work W as located in an intermediate position slightly above the former position. In the present embodiment, the grinding wheels 3, 4 have an outside diameter which is about ⅔ the outside diameter of the work W, and the center c of the work W as supported in the grinding position is positioned upwardly of the centers of the wheels 3, 4. When the work W is supported in the grinding position, the lower-side portion of the work W including the center c thereof is positioned between the grinding wheels 3, 4, with the remaining upper-side portion positioned externally of the wheels 3, 4. The opposite surfaces a and b of the work W are opposed respectively to the left and right grinding faces 3*a*, 4*a*, with the outer periphery of the work W intersecting the outer peripheries of the grinding faces 3*a*, 4*a*, and the center c of the work W is positioned inwardly of the faces 3*a*, 4*a* (between the inner periphery and the outer periphery of each of the grinding faces 3*a*, 4*a*).

The guide rollers 10 hold the work W in position radially thereof by contact with the outer periphery of the portion of the work W projecting outward from between the wheels 3, 4, and are arranged at locations where the circumference of the work W is divided into three equal portions, i.e., at the location of the upper-side midportion of the work W in the front-rear direction, and the locations of the front and rear two portions on the lower side of the work W. The drive rollers 11 and the holding rollers 12 are provided in pairs. Three portions of the work W positioned outwardly of the grinding wheels 3, 4 are each held between the drive roller 11 and the holding roller 12 at the left and right to hold the work W in position axially thereof (transversely of the apparatus). The holding roller 12 is pressed into contact with the right surface b to be worked on of the work W by an unillustrated spring to press the left surface a to be worked on of the work W against the drive roller 11. The drive roller 11 is rotatingly driven by an electric motor 13, rotating in pressing contact with the work surface a to rotate the work W. The holding roller 12 is idly rotated by pressing contact with the work surface b. The drive rollers 11 and the holding rollers 12 are arranged at three of locations where the circumference of the work W is divided into four equal portions, i.e., at the location of the upper-side midportion of the work W in the front-rear direction, and the locations of the front and rear two midportions of the work W in the vertical direction.

Figure 5:
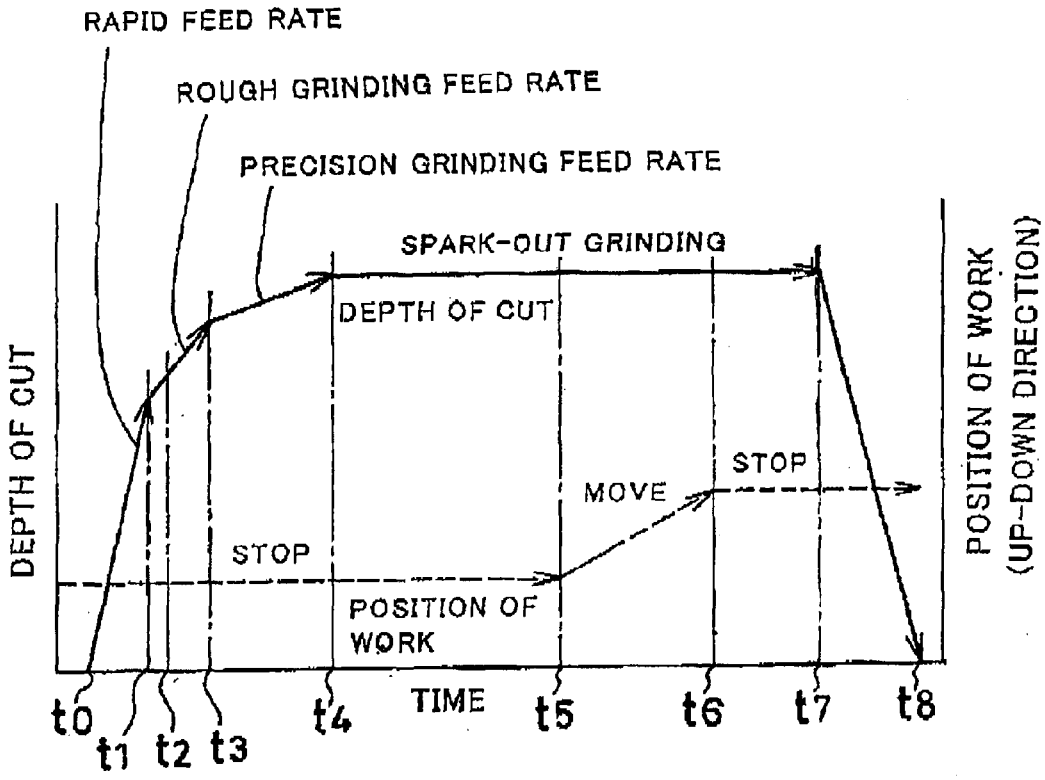
FIG. 5 is a diagram showing variations in the depth of cut by the grinding wheels and the position of the work in upward or downward direction, as determined with time during grinding.

With reference to FIGS. 4 and 5, a description will be given of an example of double side grinding operation by the grinding apparatus for the work W. FIG. 5 shows the variation in the depth of cut by the grinding wheels 3, 4 and the shift in the position of the work W in upward or downward direction, as determined with time during the grinding operation. The depth of cut by the grinding wheels 3, 4, is indicated by the solid line, and the position of the work W by the broken line.

During the grinding operation, the opposite grinding wheels 3, 4, are in rotation in the same direction at the same speed as indicated by arrows in FIGS. 2 and 3.

With the grinding wheels 3, 4 at a halt in the standby position as spaced apart from each other transversely of the apparatus, the required rollers 10, 11, 12 of the rotating device 1 are moved to the standby position. Work W is fed to the rotating device 1 by an unillustrated work transport device, and the above-mentioned required rollers 10, 11, 12 are moved to the operative position to support the work W. When the grinding operation is to be started, the work W is supported at the grinding position as indicated in a solid line in FIG. 2 (chain line in FIG. 3), and the center c of the work W is positioned between the outer periphery of the lower portion of each of the grinding faces 3*a*, 4*a* and the inner periphery thereof, with the upper-side portion of the work W located between the opposed grinding wheels 3, 4. FIG. 4(*a*) shows the position of the work W relative to the wheels 3, 4 as the work is seen from the front at this time.

The drive rollers 11 start to rotate when the work W is suppoarated in the grinding position. The rotation of the drive rollers 11 rotates the work W about its center c in a direction depending on the direction of rotation of the drive rollers 11 as indicated by the arrows in FIGS. 2 and 3 at a lower speed than the grinding wheels 3, 4 while the work W is held in position radially and axially thereof by the rolllers 10, 11, 12.

At the same time (at time t0 in FIG. 5), the directions of depth of cut at a relatively high rapid feed rate. When brought closer to the work W to come extent (time t1), the grinding wheels 3, 4 are further moved each toward the direction of depth of cut at a rough grinding feed rate that is lower than the rapid feed rate, whereby the grinding faces 3*a*, 4*a* are brought into contact with the respective corresponding surfaces a, b to be worked on (time t2) for the wheels 3, 4 to advance in the direction of depth of cut axially thereof. FIG. 4(*b*) shows the position of the work W relative to the wheels 3, 4 as they are seen from the front when the grinding faces 3*a*, 4*a* are brought into contact with the surfaces a, b. Upon advancing to the position of a predetermined depth of cut (time t3), each of the wheels 3, 4 is further moved in the direction of depth of cut at a lower precision grinding feed rate. Upon advancing to the position of a predetermined depth of cut (time t4), each of the wheels 3, 4 is stopped from advancing in the direction of depth of cut to start spark-out grinding.

Before spark-out grinding is completed (time t5), the actuator 9 of the moving device 2 is driven to pivotally move the support member 7 upward, with the grinding wheels 3, 4 stopped from advancing depthwise, whereby the rotating device 1 and the work W thereby supported are moved upward from the grinding position. To position the center c of the work W externally of the grinding faces 3*a*, 4*a* in this case, the work W needs to be moved at least ½ the width of the grinding faces 3*a*, 4*a*. When the work W is moved to a predetermined position where the center C of the work W is located upwardly externally of the grinding faces 3*a*, 4*a* (time t6), the actuator 9 is brought out of operation to halt the rotating device 1 and the work W for continued spark-out grinding. Upon completion of spark-out grinding (time t7), the grinding wheels 3, 4 are moved to the standby position where the wheels are separated from each other transversely of the apparatus to position the grinding faces 3*a*, 4*a* away from the work surfaces a, b (time t8). FIG. 4(*c*) shows the position of the work W relative to the grinding wheels 3, 4 when the work W is moved to the position where the center c of the work W is located externally of the grinding faces 3*a*, 4*a*.

Upon the grinding wheels 3, 4 leaving the work W, the support member 7 of the moving device 2 is halted, and the work W completely ground is delivered from the rotating device 1 by the work transport device, with the wheels 3, 4 held in the standby position. The next work W is then fed to the rotating device 1 for grinding in the same manner as above.

The surfaces a, b of the work W in contact with the respective grinding faces 3*a*, 4*a* are ground by the rotation of the wheels 3, 4 while the wheels 3, 4 advance in the directions of depth of cut and during the spark-out grinding until time t5. The entire surfaces a, b of the work W pass between the grinding faces 3*a*, 4*a* in contact therewith while the work W makes one turn of rotation about its center c, with the outer periphery of the work W intersecting the outer peripheries of the grinding faces 3*a*, 4*a* and with the center c positioned inwardly of the grinding faces 3*a*, 4*a*, with the result that both the work surfaces a, b are entirely ground at the same time while the work makes a number of turns of rotation. At this time, the portion of the work W other than the portion thereof in the vicinity of its center c comes into contact with the grinding faces 3*a*, 4*a* only during a portion of the time taken for each turn of rotation of the work W, whereas the portion in the vicinity of the center c is in contact with the grinding faces 3*a*, 4*a* at all times. Accordingly the thickness of the work W is great toward its outer periphery and small in the vicinity of the center C when the spark-out grinding operation is performed until time t5. However, when the center c of the work W is positioned externally of the grinding faces 3*a*, 4*a* by the movement of the work W subsequent to time t5, the vicinity of the center c of the work W is completely held out of contact with the grinding faces 3*a*, 4*a*. The thick portion of the work W other than the vicinity of the center c thereof is ground during the movement of the work W after the center c of the work W is positioned externally of the grinding faces 3*a*, 4*a* and while the work W is subsequently held at a halt. When the spark-out grinding operation is completed at time t7, the difference in thickness between the vicinity of the center c of the work W and the other portion thereof is smaller than at time t5, with the result that the work W as ground is diminished in variations of thickness.

The rate of movement of the work W in a direction parallel to the surfaces a, b thereof to be worked on is determined according to the accuracy of thickness required of the work W.

The constructions of the grinding machine, work rotating device, moving device, etc. of the double side grinding apparatus and the method of grinding work are not limited to those of the embodiment described but can be altered suitably.

The present invention is applicable not only to grinding machines of the horizontal type wherein a pair of grinding wheels are opposed to each other horizontally like the foregoing embodiment but also to those of the vertical type wherein a pair of grinding wheels are opposed to each other vertically.

The present invention is applicable also to the double side grinding of work having a positioning flat portion at an outer peripheral portion thereof. The work rotating device for use in this case has a pair of outer periphery guide rollers which are spaced apart by a distance slightly greater than the circumferential dimension of the positioning flat portion and disposed at each of three locations around the work.

According to the foregoing embodiment, spark-out grinding is continued after the moving work W is halted, and the grinding faces 3*a*, 4*a* are moved away from the work surfaces a, b after the completion of spark-out grinding, whereas the spark-out grinding operation may be terminated simultaneously when the moving work W is brought to a halt to remove the grinding faces 3*a*, 4*a* from the work surfaces a, b.

Further with the foregoing embodiment, the grinding wheels 3, 4 are moved away from each other transversely of the apparatus to separate the grinding faces 3*a*, 4*a* from the work surfaces a, b when the spark-out grinding operation is terminated, with the work W positioned between the opposite grinding faces 3*a*, 4*a* and with the outer peripheries of these faces 3*a*, 4*a* intersecting the outer peripheries of the work surfaces a, b. However, the grinding faces 3*a*, 4*a* may be moved away from the work surfaces a, b by moving the work W in a direction parallel to the surfaces a, b until the work W is brought out from between the opposed grinding faces 3*a*, 4*a*.

Although the grinding wheels 3, 4 are advanced in the directions of depth of cut by being moved axially thereof according to the foregoing embodiment, the work may be given the depth of cut by moving one of the wheels 3, 4 and the work W in the axial direction.

The present invention will be described below in greater detail with reference to an example of the invention and comparative example. However, the invention is not limited by the example.

EXAMPLE

The double side grinding apparatus shown in FIG. 1 was used for grinding silicon wafers over both surfaces thereof.

The silicon wafers used were prepared by slicing with a wire saw a silicon single-crystal ingot produced by the CZ process and about 1 mm in thickness, 200 mm (8 inches) in diameter and (100) in plane orientation.

Grinding wheels of vitrified #2000 (3 mm in width) were used at a rotational speed of 2500 rpm, with the wafer rotated at 25 rpm.

First, the grinding wheels were moved toward each other in the directions of depth of cut at a relatively high rapid feed rate. When the wheels were brought closer to the wafer to some extent, the infeed rate was set at a feed rate of 100 $\mu$m/min for rough grinding. When the wafer was ground to a depth of 50 $\mu$m on each side after the wheels were brought into contact with the wafer surfaces to be worked on, by moving the grinding wheels in the directions of depth of cut, the rate was changed to a feed rate of 50 $\mu$m/min for precision grinding. When the wafer was ground further by 10 $\mu$m on each side, the wheels were stopped from advancing in the directions of the depth of cut, and spark-out grinding was started. Six seconds after the start of spark-out grinding, the wafer was moved 6 mm upward at a rate of 40 mm/min in parallel to the wafer surface to be worked on. The wafer was rotated at a speed of 2.5 rpm at this time. The wheels were thereafter moved to the standby position to complete the grinding operation.

Twenty silicon wafers ground under the above conditions were checked for thickness by measuring the flatness of both surfaces thereof. The flatness was measured using Ultra Gage 9700+, product of ADE (flatness measuring instrument of the capacitance type).

As a result, the 20 wafers were 0.50 $\mu$m in the average value of GBIR (Global Backside Ideal Range) and 0.056 $\mu$m in standard deviation. Further the average value of SBIR (Site Backside Ideal Range, Cell Size=25 mm×25 mm, Offset=12.5 mm×12.5 mm) at the wafer center was 0.24 $\mu$m, with a standard deviation of 0.041 $\mu$m.

Figure 6:
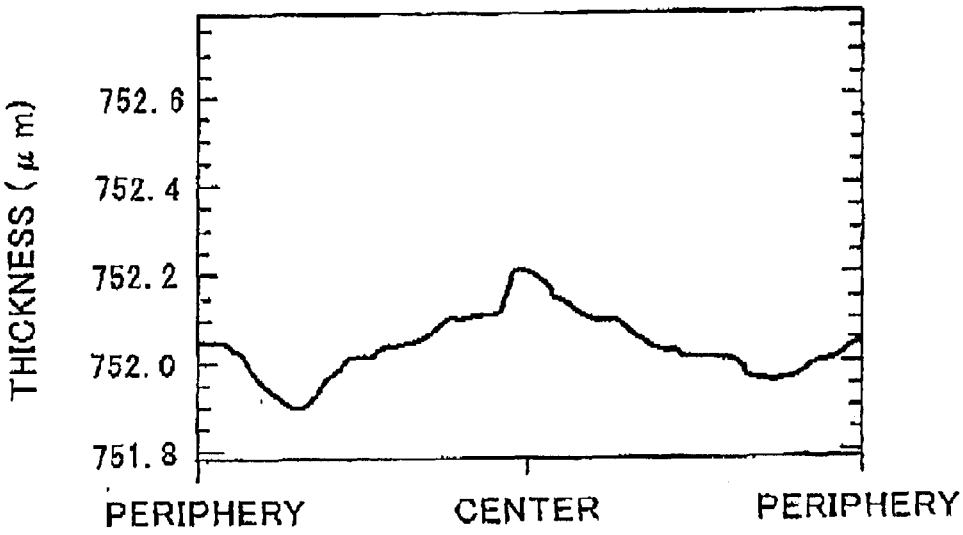
FIG. 6 is a graph showing a distribution of thicknesses in the diametrical direction of wafers ground over opposite surfaces in an example of the invention.

FIG. 6 shows the distribution of thickness measurements of the wafers in the diametrical direction of thereof, the measurements being obtained in this example. FIG. 6 reveals that the wafers of this examples were not diminished in the thickness of the wafer central portion.

Comparative Example

Silicon wafers were ground over opposite surfaces under the same conditions as in Example except that the wafers were not moved during the spark-out grinding operation.

As a result, the 20 wafers were 0.69 $\mu$m in the average value of GBIR, 0.042 $\mu$m in standard deviation, 0.40 $\mu$m in the average value of SBIR at the central portion of the wafer and 0.042 $\mu$m in the standard deviation concerned.

Figure 7:
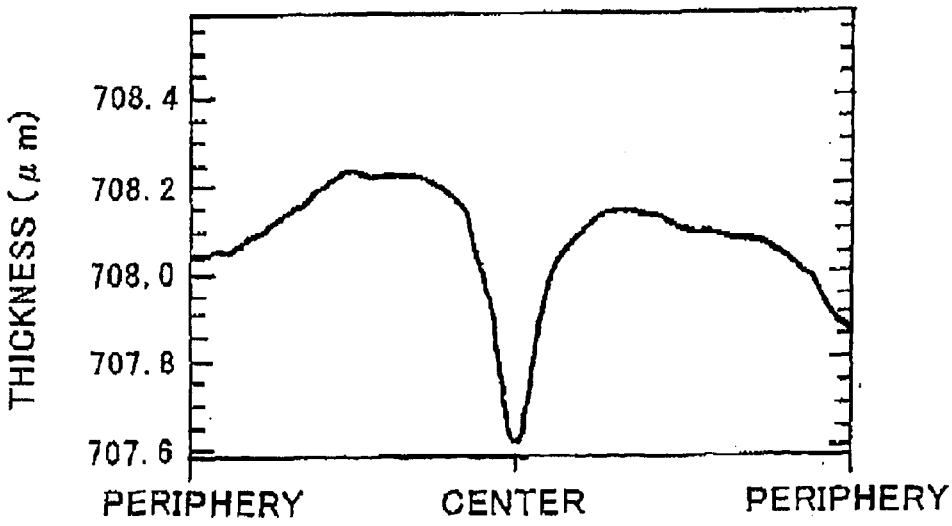
FIG. 7 is a graph showing a distribution of thicknesses in the diametrical direction of wafers ground over opposite surfaces in a comparative example.

The thickness measurements obtained in the comparative example were used to show the distribution of thicknesses of the wafers in the diametrical direction of thereof as seen in FIG. 7. FIG. 7 reveals that the wafers are markedly reduced in thickness at the central portion of the wafer.

INDUSTRIAL APPLICABILITY

The double side grinding process and apparatus of the invention for thin disklike work are suitable for use in grinding opposite surfaces of thin disklike work such as semiconductor wafers.

What is claimed is:

1. A double side grinding process for grinding opposite surfaces of thin disklike work simultaneously with annular grinding faces of ends of a pair of grinding wheels arranged as opposed to each other, the process comprising the steps of:

bringing the grinding faces into contact with the respective work surfaces to advance each grinding face to the position of a predetermined depth of cut by moving at least one of the grinding wheels while rotating the grinding wheels and rotating the work about an axis thereof as supported in a predetermined grinding position between the grinding wheels so that an outer periphery of the work intersects outer peripheries of the grinding wheels with a center of the work positioned inwardly of the grinding faces, stopping each of the grinding wheels from advancing in the direction of depth of cut, moving each of the grinding wheels and the work relative to each other in a direction parallel to the work surface until the center of the work is positioned externally of the grinding faces and separating the grinding faces from the work surfaces.

2. A double side grinding process for thin disklike work according to claim 1 wherein in said step of bringing the grinding faces into contact with the respective work surfaces, each of the grinding wheels and the work are moved relative to each other in a direction parallel to the work surface with the work rotated at a lower speed than in the preceding grinding operation.

3. A double side grinding process for thin disklike work according to claim 1 wherein in said step of bringing the grinding faces into contact with the respective work surfaces, each of the grinding wheels and the work are moved relative to each other in a direction parallel to the work surface by moving the work in a direction parallel to the work surface.

4. A double side grinding apparatus for thin disklike work comprising:

a pair of rotatable grinding wheels having opposed annular grinding faces at respective ends thereof and so arranged as to be movable relative to each other axially thereof, work rotating means for rotating the thin disklike work about an axis thereof while supporting the work in a grinding position between the grinding faces so that opposite surfaces of the work to be worked on face the respective grinding faces of the wheels, moving means for moving each of the grinding wheels and the work rotating means relative to each other in a direction parallel to the surfaces of the work supported by the rotating means, means for bringing the grinding faces into contact with the respective work surfaces to advance each grinding face to the position of a predetermined depth of cut by moving at least one of the grinding wheels while rotating the grinding wheels and rotating the work about an axis thereof as supported in a predetermined grinding position between the grinding wheels so that an outer periphery of the work intersects outer peripheries of the grinding wheels with a center of the work positioned inwardly of the grinding faces, means for stopping each of the grinding wheels from advancing in the direction of depth of cut, and means for moving each of the grinding wheels and the work relative to each other in a direction parallel to the work surface until the center of the work is positioned externally of the grinding faces and separating the grinding faces from the work surfaces.

5. A double side grinding apparatus for thin disklike work according to claim 4 wherein the moving means moves the work in a direction parallel to the work surface to thereby move each of the grinding wheels and the work relative to each other in a direction parallel to the work surface.

* * * * *